US010039366B1

(12) United States Patent
Facer et al.

(10) Patent No.: US 10,039,366 B1
(45) Date of Patent: Aug. 7, 2018

(54) DUAL BALM APPLICATOR AND METHOD OF MANUFACTURE

(71) Applicant: SNUGZ/USA INCORPORATED, West Jordan, UT (US)

(72) Inventors: C. Michael Facer, Syracuse, UT (US); Cade Andersen, Kaysville, UT (US)

(73) Assignee: SNUGZ/USA INCORPORATED, West Jordan, UT (US)

( * ) Notice: Subject to any disclaimer, the term of this patent is extended or adjusted under 35 U.S.C. 154(b) by 127 days.

(21) Appl. No.: 14/863,627

(22) Filed: Sep. 24, 2015

Related U.S. Application Data

(60) Provisional application No. 62/055,205, filed on Sep. 25, 2014, provisional application No. 62/093,223, filed on Dec. 17, 2014.

(51) Int. Cl.
*A45D 40/24* (2006.01)
*B67C 3/22* (2006.01)

(52) U.S. Cl.
CPC ..... *A45D 40/24* (2013.01); *B67C 3/22* (2013.01)

(58) Field of Classification Search
CPC combination set(s) only.
See application file for complete search history.

(56) References Cited

U.S. PATENT DOCUMENTS 1,417,333 A 5/1922 Kendall
1,852,455 A 10/1930 Friedman
2,092,700 A 1/1935 Susini
2,171,112 A 12/1936 Hoffman
2,314,338 A 11/1940 Graves
2,568,688 A 3/1949 Shatkin
2,631,317 A 3/1953 De
2,859,085 A 8/1953 Morrison
2,745,642 A 5/1956 Hermann
2,797,839 A 7/1957 Roy
2,941,689 A 6/1960 Black
3,156,279 A 11/1964 Grebowiec et al.
3,163,544 A 12/1964 Valyl
3,312,262 A 4/1967 Hunter
(Continued)

FOREIGN PATENT DOCUMENTS

CN 300909811 1/2008
EP 0628393 12/1994
(Continued)

OTHER PUBLICATIONS

Amazon.com: Covergirl Blast Lipstick Lipcolor Pucker 0.134 Oz: Lipstick: Beauty, dated Aug. 22, 2014, 7 pages.
(Continued)

*Primary Examiner* — David Walczak
(74) *Attorney, Agent, or Firm* — Workman Nydegger

(57) ABSTRACT

A dual balm applicator, comprises two balm assemblies that are attached to each other, wherein each of the two balm assemblies comprises: (i) a perforated mounting structure; (ii) a balm mounted on the perforated mounting structure; and (iii) a cover configured to be selectively, removably mounted on the perforated mounting structure, wherein the perforated mounting structures of each respective balm assembly are attached, such that the balms of each respective balm assembly extend away from the respective attached perforated mounting structures for convenient use by a user.

20 Claims, 13 Drawing Sheets

(56) References Cited

U.S. PATENT DOCUMENTS

| | | | | |
|---|---|---|---|---|
| 3,385,503 | A | 5/1968 | Stump | |
| 3,664,353 | A | 5/1972 | Childress | |
| 3,741,379 | A | 6/1973 | Kappler et al. | |
| 3,843,120 | A | 10/1974 | Ricci | |
| 4,235,557 | A | 11/1980 | Hayes | |
| D266,146 | S | 9/1982 | Morris | |
| 4,369,158 | A | 1/1983 | Woodruff et al. | |
| D267,822 | S | 2/1983 | Katz | |
| 4,728,210 | A | 3/1988 | Barish | |
| 4,765,501 | A | 8/1988 | Kao | |
| D306,562 | S | 3/1990 | Barish et al. | |
| 4,915,528 | A | 4/1990 | Seager | |
| 5,025,817 | A | 6/1991 | Wen | |
| 5,044,496 | A | 9/1991 | Tanaka | |
| 5,064,082 | A | 11/1991 | Lombardi | |
| 5,092,700 | A | 3/1992 | Susini et al. | |
| 5,096,078 | A | 3/1992 | McQueeny | |
| 5,099,998 | A | 3/1992 | Curzon et al. | |
| 5,137,185 | A | 8/1992 | Mitchell | |
| D333,014 | S | 2/1993 | Lang | |
| D333,784 | S | 3/1993 | Goodman | |
| D335,085 | S | 4/1993 | D'Andrea | |
| D339,986 | S | 10/1993 | Garouste | |
| D348,123 | S | 6/1994 | Wu | |
| 5,326,185 | A | 7/1994 | Dornbusch et al. | |
| 5,326,564 | A | 7/1994 | LaRosa | |
| D349,976 | S | 8/1994 | Connell | |
| 5,496,122 | A | 3/1996 | Fattori | |
| 5,503,825 | A | 4/1996 | Lane | |
| 5,505,041 | A | 4/1996 | Harlan | |
| 5,542,552 | A | 8/1996 | Yablans et al. | |
| 5,542,557 | A | 8/1996 | Koyama | |
| 5,749,460 | A | 5/1998 | Rice | |
| 5,799,667 | A | 9/1998 | Szekely | |
| 5,829,900 | A | 11/1998 | Brown | |
| 5,829,901 | A | 11/1998 | Brown | |
| D404,530 | S | 1/1999 | Liese | |
| 5,884,637 | A * | 3/1999 | Joulia | A45D 33/00 132/318 |
| D412,115 | S | 7/1999 | D'Andrea | |
| 5,983,905 | A | 11/1999 | Patching | |
| D421,216 | S | 2/2000 | Abrams | |
| 6,050,438 | A | 4/2000 | Kovens et al. | |
| 6,102,209 | A | 8/2000 | D'Andrea | |
| 6,193,427 | B1 | 2/2001 | Benguigui | |
| 6,228,351 | B1 | 5/2001 | Viders | |
| D443,726 | S | 6/2001 | Faillant-Dumas | |
| 6,276,853 | B1 | 8/2001 | Breidenbach | |
| 6,286,520 | B1 | 9/2001 | Lin | |
| 6,391,972 | B1 | 5/2002 | Hatakeyama | |
| 6,409,034 | B2 | 6/2002 | Schorner | |
| 6,464,418 | B1 * | 10/2002 | Visser | A45D 33/00 206/509 |
| D465,614 | S | 11/2002 | Petit | |
| D465,733 | S | 11/2002 | Hill | |
| D475,288 | S | 6/2003 | Hoffmann | |
| 6,682,242 | B1 * | 1/2004 | Montoli | A45D 34/045 401/126 |
| 6,688,795 | B1 | 2/2004 | Jacob | |
| D489,148 | S | 4/2004 | Sheng | |
| D492,403 | S | 6/2004 | Iddan | |
| 6,745,987 | B2 | 6/2004 | Rousselet | |
| 6,773,187 | B2 | 8/2004 | Gueret | |
| D529,397 | S | 10/2006 | Lavigne | |
| D534,076 | S | 12/2006 | Green et al. | |
| D552,473 | S | 10/2007 | Simkin | |
| D554,529 | S | 11/2007 | Green | |
| D561,030 | S | 2/2008 | Simkin | |
| D562,699 | S | 2/2008 | Green et al. | |
| D564,900 | S | 3/2008 | Green | |
| D573,026 | S | 7/2008 | Tsai | |
| D583,100 | S | 12/2008 | Jackel | |
| D584,950 | S | 1/2009 | Delalande | |
| D592,064 | S | 5/2009 | Kilany | |
| D602,311 | S | 10/2009 | Finell | |
| 7,631,781 | B2 | 12/2009 | Chen | |
| D612,245 | S | 3/2010 | Puigbo | |
| 7,695,727 | B2 | 4/2010 | Magee | |
| 7,699,062 | B2 | 4/2010 | Sasaki | |
| D625,469 | S | 10/2010 | Dubitsky | |
| D631,204 | S | 1/2011 | Dubitsky et al. | |
| D644,939 | S | 9/2011 | Teller | |
| D645,751 | S | 9/2011 | Back | |
| D650,280 | S | 12/2011 | Peyerimhoff | |
| 8,096,308 | B2 | 1/2012 | Ramos | |
| D655,168 | S | 3/2012 | In | |
| D656,829 | S | 4/2012 | Watabe | |
| D692,320 | S | 1/2013 | Seymour | |
| D681,278 | S | 4/2013 | Schlatter | |
| 8,444,337 | B2 | 5/2013 | Teller | |
| 8,528,778 | B2 | 9/2013 | Giraud | |
| 8,651,308 | B1 | 2/2014 | Sung | |
| 8,888,391 | B2 | 11/2014 | Teller et al. | |
| 8,979,408 | B2 * | 3/2015 | Reed | A45D 40/26 401/17 |
| 2002/0071707 | A1 | 6/2002 | Breidenbach | |
| 2003/0077102 | A1 | 4/2003 | Bourjal | |
| 2003/0086989 | A1 | 5/2003 | Jensen et al. | |
| 2003/0161851 | A1 | 8/2003 | Breha | |
| 2003/0201201 | A1 | 10/2003 | Cheng | |
| 2004/0003825 | A1 | 1/2004 | Kelly | |
| 2006/0018702 | A1 | 1/2006 | Tavares da Silva | |
| 2006/0062630 | A1 * | 3/2006 | Yeh | B43K 27/00 401/18 |
| 2006/0099026 | A1 | 5/2006 | Griffon | |
| 2006/0201838 | A1 | 9/2006 | Sasaki | |
| 2006/0254945 | A1 | 11/2006 | Green | |
| 2007/0108092 | A1 | 5/2007 | Minuto | |
| 2008/0145135 | A1 | 6/2008 | Scanlon et al. | |
| 2009/0022541 | A1 | 1/2009 | De Laforcade | |
| 2011/0024316 | A1 | 2/2011 | Ginsburg | |
| 2011/0135377 | A1 | 6/2011 | Teller | |

FOREIGN PATENT DOCUMENTS

| | | |
|---|---|---|
| EP | 1588644 | 10/2005 |
| EP | 159471 | 11/2005 |
| EP | 1832198 | 12/2007 |
| EP | 1842789 | 10/2011 |
| EP | 2218654 | 3/2012 |
| ES | D0505578-01 | 11/2007 |
| FR | 2563711 | 3/1984 |
| FR | 2714581 | 1/1994 |
| FR | 2726443 | 3/1995 |
| FR | 2766339 | 7/1997 |
| FR | 2925263 | 6/2009 |
| FR | 2996431 | 4/2014 |
| GB | 654725 | 6/1951 |
| GB | 1149202 | 4/1969 |
| GB | D2007213 | 5/1979 |
| GB | 2162822 | 2/1986 |
| JP | 1136041 | 3/2002 |
| JP | 455237 | 6/2003 |
| JP | D1175238 | 6/2003 |
| JP | 2004106932 | 4/2004 |
| JP | 2004321410 | 11/2004 |
| JP | 2006204821 | 8/2006 |
| KR | 20090006972 | 1/2009 |
| KR | 300556875 | 3/2009 |
| WO | 2007007288 | 1/2007 |
| WO | 20110171792 | 6/2011 |

OTHER PUBLICATIONS

Amazon.com: Bath & Body Works Liplicious Double Kiss 2-in-1 Moisturizing Lip Color, dated Aug. 22, 2014, 3 pages.

Amazon.com: Cover Girl Blast Flipstick Lipstick Glimmer, dated Aug. 22, 2014, 3 pages.

Bite brand Dual Lip Stick Container Assembly with Lip Stick and Packaging, sold and publicly available, on information and belief, at least as early as Aug. 22, 2014 (21 images) (6 pages) (images 11 and 14-21 showing lip stick mount from one side disassembled and with lip stick partially removed).

(56) References Cited

OTHER PUBLICATIONS

Blamtastic brand Lip Balm Container Assembly (shown with lip balm removed), sold and publicly available, on infollnation and belief, with lip balm, at least as early as Jun. 2015 (9 images) (3 pages).
Blamtastic brand Lip Balm Container Assembly with lip balm and packaging, sold and publicly available, on infoimation and belief, at least as early as Jun. 2015 (8 images) (2 pages).
Couture Monday: Givenchy's pocket watch lip gloss, *The Makeup Museum*, Oct. 2008, http://www.makeupmuseum.org/home/2008/10/ (1 page).
EOS brand Lip Balm Container Assembly with Balm and Packaging, sold and publicly available, on information and belief, at least as early as Nov. 30, 2014 (10 images) (3 pages).
Gojane double-sided lipstick, http://ep.yimp.com/ay/gojane/double-sided-lipstick-50, dated Aug. 22, 2014, (1 page).
Jemma Kidd Make Up Ultimate Lipstick Duo, Peggy .04 oz: Beauty, dated Aug. 22, 2014, (4 pages).
Lip Balm Container Assembly (shown without balm); sold and publicly available (with balm), on information and belief, at least as early as Apr. 2, 2014 (15 images) (4 pages).
Lip balm with spherical surface and method for producing, Google Patents Search, dated Oct. 21, 2015, (5 pages).
Provisional application, Filing Receipt, and Electronic Transmittal and Acknowledgment of U.S. Appl. No. 61/222,966, filed Jul. 3, 2009 (24 pages).
Review: Ballmania Lip Balm SPF 20. Yahoo Contributor Network, published, on information and belief, at least as early as Oct. 12, 2007, (1 page).
Revo brand "Mint" Lip Balm Container Assembly with balm, sold and publicly available, on information and belief, at least as early as Apr. 2, 2014 (6 images) (2 pages).
Revo brand Lip Balm Container Assembly (shown without balm), sold and publicly available with balm, on information and belief, at least as early as Apr. 2, 2014 (13 images) (4 pages).
SavonTV.com, Ballmania Premium Lip Balm, published, on information and belief, at least as early as Dec. 29, 2006, www.savontv.com/ballmania.html (3 pages).
SavonTV.com, published, on information and belief, at least as early as Mar. 23, 2007, (2 pages).
Softlips Cube brand Lip Balm Container Assembly with Balm and Packaging, sold and publicly available, on information and belief, at least as early as Nov. 30, 2014 (12 images) (3 pages).
Sonia Kashuk Spring 2008 Beauty at Target, dated Jan. 1, 2008 (4 pages).
Spherical jars PT—0057, Feb. 2008 (2 pages).
Style + Substance Ballmania Premium Lip Balm, published, on information and belief, at least as early as Nov. 29, 2004, (1 page).
Style + Substance, Ballmania Premium Lip Balm, published, on information and belief, at least as early as Nov. 29, 2004, (2 pages).
*The Kind Group LLC* v. *Black Bear Promotions Complaint, Inc.* filed Feb. 25, 2013 (22 pages).
Kisstixx Double Ended Flavored Lip Balms from Shark Tank on QVC, published, on information and belief, at least as early as Aug. 2013 (3 pages).
Civil Docket (dated Jul. 26, 2016) and Complaint for Case #: 1:11-cv-08349-JGK (24 pages), U.S. District Court, Southern District of New York.
Civil Docket (dated Jul. 26, 2016) and Complaint for Case #: 1:12-cv-01487-PKC (31 pages), U.S. District Court, Southern District of New York.
Civil Docket (dated Jul. 26, 2016) and Complaint for Declaratory Judgement with Jury Demand for Case #: 1:13-cv-00170-PAB-KLM (48 pages), U.S. District Court, District of Colorado.
Civil Docket (dated Jul. 26, 2016) and Complaint for Case #: 1:13-cv-01258-WHP (24 pages), U.S. District Court, Southern District of New York.
Civil Docket (dated Jul. 26, 2016) and Complaint for Trademark Counterfeiting, Trade Dress and Trademark Infringement, Unfair Competition, Misappropriation and Design Patent Infringement for Case #: 1:15-cv-04082-LTS (32 pages), U.S. District Court, Southern District of New York.

* cited by examiner

DUAL BALM APPLICATOR AND METHOD OF MANUFACTURE

RELATED APPLICATIONS

This non-provisional patent application claims priority to and the benefit of each of (i) provisional patent application No. 62/055,205 filed Sep. 25, 2014 entitled Dual Balm Applicator and Method of Manufacture, which is incorporated herein in its entirety by reference; and (ii) provisional patent application No. 62/093,223 filed Dec. 17, 2014 entitled Dual Balm Applicator and Method of Manufacture, which is incorporated herein in its entirety by reference.

BACKGROUND OF THE DISCLOSURE

1. Technical Field

The present invention relates generally to balm applicators.

2. The Relevant Technology

The world is subject to changing weather conditions, whether as a result of seasonal shifts or fluctuations within each season. Exposure to the elements throughout these shifts, or even long-term exposure to hot or cold temperatures, can potentially cause many ailments. Some of these include sunburn and chapped lips. Sunburn is the result of overexposure of the epidermis to ultraviolet radiation and is often uncomfortable and can be quite painful. More severe sunburns can lead to a breach in the epidermal defense and lead to serious infection. In addition to sunburn, exposure to the elements can cause chapped lips. Chapped lips can be uncomfortable, unsightly, and could—in more serious cases—lead to painful cracking and possibly infection.

Certain salves, balms, lotions, and ointments are designed to prevent sunburns and the chapping of lips. Sunscreen can come in many forms but is prevalent as a spray, balm, or lotion. Chapsticks, lip balms, or gels—typically in a tube or stick—are available for preventing and treating chapped lips.

SUMMARY OF THE DISCLOSURE

This applications relates to new dual applicators—together with associated manufacturing processes—for use applying cosmetic balms and/or other balms to, for example, protect against sunburns and/or chapped lips. The disclosed dual balm applicator has the advantage of combining two balm applicators in a single device. In some embodiments, one end of the dual balm applicator can be a lip balm and the other a sunscreen balm. In another embodiment, the dual balm applicator comprises two separate lip balms. The dual balm design has the advantage of providing different functional balms (e.g., a sunscreen and a lip balm) that complement one another and can be carried in a single dual-sided applicator. Similarly, the presently disclosed art can provide two functionally similar balms (e.g., two lip balms) having different aesthetic and/or functional properties, such as glossy or non-glossy lip balms having a moisturizer or lacking it. In yet another embodiment, the dual balms could comprise different flavored lip balms.

This summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

Additional features and advantages of exemplary implementations of the invention will be set forth in the description which follows, and in part will be obvious from the description, or may be learned by the practice of such exemplary implementations. The features and advantages of such implementations may be realized and obtained by means of the instruments and combinations particularly pointed out in the appended claims. These and other features will become more fully apparent from the following description and appended claims, or may be learned by the practice of such exemplary implementations as set forth hereinafter.

BRIEF DESCRIPTION OF THE DRAWINGS

In order to describe the manner in which the above recited and other advantages and features of the invention can be obtained, a more particular description of the invention briefly described above will be rendered by reference to specific embodiments thereof, which are illustrated in the appended drawings. Understanding that these drawings depict only typical embodiments of the invention and are not therefore to be considered to be limiting of its scope, the invention will be described and explained with additional specificity and detail through the use of the accompanying drawings in which:

FIG. 7A is a perspective view, FIG. 7B is a front view, FIG. 7C is a right side view, FIG. 7D, is a back view, FIG. 7E is a left side view, FIG. 7F is a top view, and FIG. 7G is a bottom view;

FIG. 8A is a perspective view, FIG. 8B is a front view, FIG. 8C is a right side view, FIG. 8D, is a back view, FIG. 8E is a left side view, FIG. 8F is a top view, and FIG. 8G is a bottom view;

DETAILED DESCRIPTION

Figure 1:
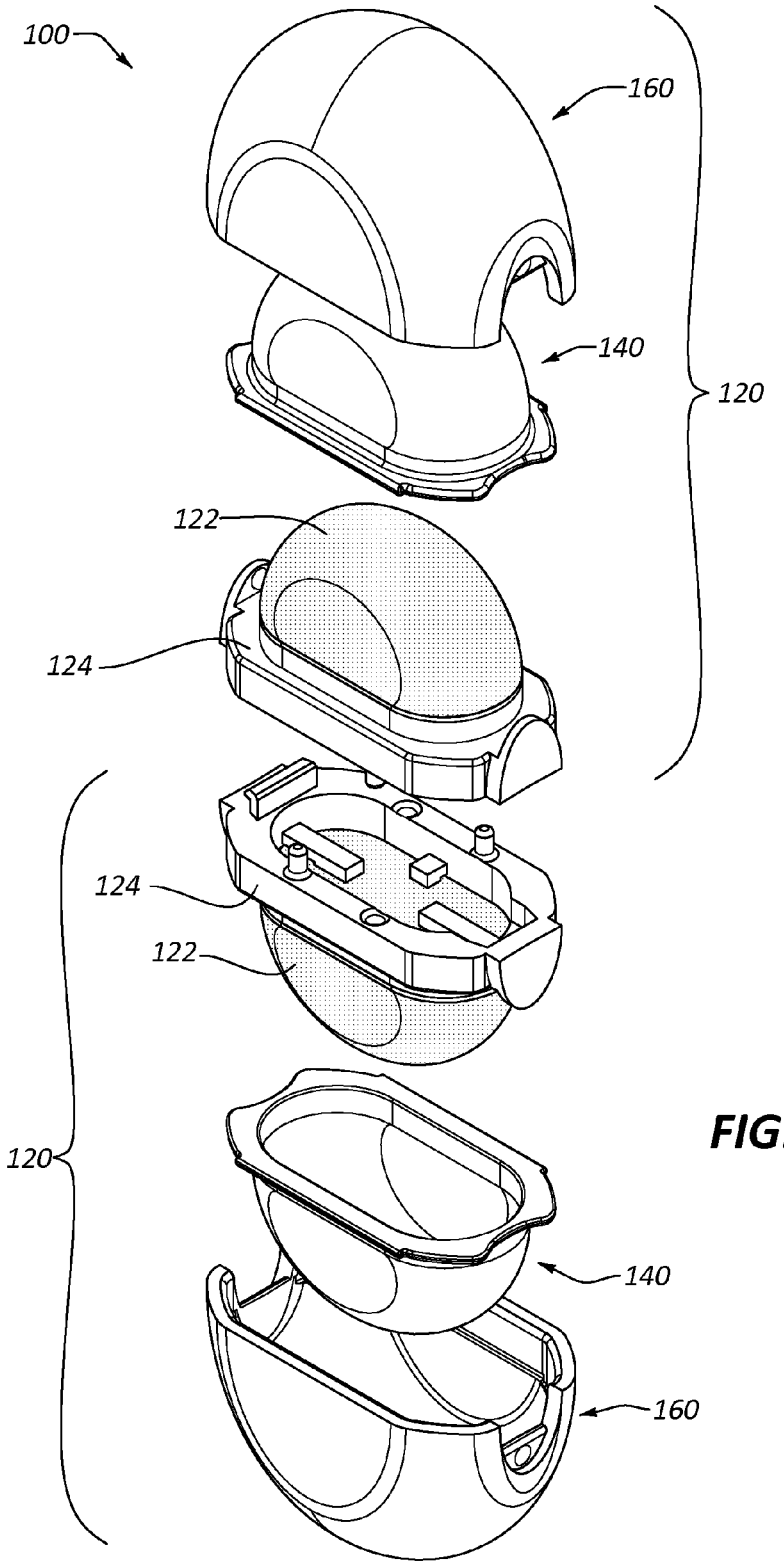
FIG. 1 depicts the components of a dual balm applicator in accordance with an embodiment of the present disclosure.

The present invention extends to balm applicators and the manufacturing of same. In particular, implementations of the present invention comprise dual balm applicators, including any of lip balms, sunscreen balms, moisturizing balms, fragrance balms, antiperspirant balms, deodorizing balms, and eye black balms, and the manufacturing of same as a single, dual-balmed applicator.

Accordingly, implementations of the present invention provide several benefits. Some embodiments may physically condense the carriage of separate cosmetics and/or balms into a single applicator, thereby increasing the ease by which multiple cosmetics and/or balms may be carried. Some embodiments may also increase the efficiency of balm application. As a non-limiting example, one of the balms of the dual-sided balm applicator may be a lip balm of sufficient size to apply the balm to both lips simultaneously.

The combination of two balms into a single applicator may also provide the convenience of having a single applicator with dual functions or properties. In at least one implementation, the dual sided balm applicator described herein can have a lip balm opposite a separate lip balm. The opposing lip balms can be of similar chemical composition with differing flavors or scents, or the opposing balms can be of different chemical composition for situational use. As a non-limiting example, one balm of the dual balm applicator may be strawberry flavored lip balm and the opposing balm of the dual balm applicator may be a chocolate flavored lip balm. As another non-limiting example, both balms of the dual balm applicator may have the same flavor and/or scent, such as for example spearmint, but one side of the balm may contain a moisturizer and sunscreen within the lip balm while the opposing balm of the dual balm applicator may only contain the lip balm without additional moisturizers or sunscreens added thereto.

Similarly, implementations of the present invention may include a dual balm applicator having two balms of different functional characteristics. In at least one implementation, one balm of the dual applicator may be used to moisten and treat chapped lips while the other balm may be used as a sunscreen for the face or other parts of the body exposed to ultraviolet radiation. Such an exemplary balm may have recreational applications such as for skiing, a sport where harsh environmental conditions may cause both chapped lips and sunburns. A skier supplied with a dual balm applicator like the foregoing may be able to conveniently protect against both sunburns and chapped lips with a single device instead of toting around two separate devices to accomplish the desired benefits of each balm.

Any dual balm applicator that includes at least one balm that may function as a sunscreen may act to increase the general well-being of its users. For example, a user may habitually apply lip balm but not habitually apply sunscreen; having a dual-balm applicator with a sunscreen balm and a lip balm may remind the user to apply sunscreen after one or more lip balm applications. This may decrease the user's chances of acquiring an ultraviolet-radiation-induced melanoma.

An additional non-limiting example of a dual balm applicator may include a dual balm where one balm is eye black that may be used by athletes to reduce glare with the other side of the applicator being a moisturizing balm. In such an embodiment, an athlete, such as a baseball player, may be able to utilize a single dual balm applicator to apply eye black to himself/herself with one side of the dual balm applicator and to care for his/her glove with the moisturizing balm on the other side of the applicator. Applicators such as the foregoing may come in a variety of various sport-related combinations.

Another non-limiting example may include a dual balm applicator having a deodorant and/or antiperspirant balm on one side and a fragrance balm on the other. By combining two balms with differing functional characteristics into a single applicator, a user may reduce the total number of devices and potentially the total volume of space occupied by separate devices. As such, dual balm applicators such as those included within the scope of the current disclosure may be beneficial for traveling or on-the-go uses such as would be convenient in a purse, pocket, or handbag.

The combinations of balms in a single, dual balm applicator as disclosed above are exemplary in nature and are, therefore, not meant to be limiting. Additional combinations and uses of balms in a dual balm applicator, which may not be specifically disclosed herein, are included within the scope of this disclosure. That is, embodiments of dual balm applicators where any single balm is combined with any other single balm having the same or different chemical properties are intended to be included within the scope of this disclosure.

It should be noted that throughout this disclosure, like structures and/or components are given like reference numerals. Furthermore, embodiments of the dual balm applicator may indicate a single reference number representing the same or substantially similar structures and/or elements reflected in each side of depicted dual balm applicators. In instances where this occurs, the description associated therewith may apply to either element individually and in some instances to each element interchangeably. In one embodiment and/or between Figures, like numbered structures may be substantially similar, and in another embodiment, like numbered structures may be identical.

Referring now to FIG. 1, depicted is an exploded view of an exemplary dual balm applicator 100, according to one embodiment of the present disclosure. Dual balm applicator 100 comprises two identical or substantially similar balm assemblies 120. Each balm assembly 120 is comprised a perforated mounting structure 124 having a balm 122 mounted thereon, a cap insert 140, and a cap 160. Each cap 160 is fitted with an insert 140 that interfaces with a balm 122 mounted on the perforated mounting structure 124 of a respective balm assembly 120.

When assembled, the dual balm applicator 100 has a functionally single central piece comprising the fixedly attached balm assemblies 120, each balm assembly attached together through the use of a compression fit, snap fit, fusion, adhesive, or other attachment method, for example. Removable caps 160 fitted with inserts 140 can be selectively, removably attached to respective perforated mounting structures 124. Each balm assembly 120, including associated balms 122, are combined and/or fully assembled to form dual balm applicator 100.

In one embodiment, FIG. 1 illustrates a single balm assembly 120 configured to fixedly attach to an identical or substantially similar balm assembly 120. In at least one embodiment, the balm 122 of an upper portion is a lip balm and the balm 122 of a lower portion is a substantially similar or identical lip balm that may, in one embodiment, differ from the upper portion balm 122 by the flavor or texture incorporated into and/or defining the lip balm 122.

In another embodiment, upper balm 122 is a sunscreen. The opposing lower balm 122 may, in one embodiment, be another sunscreen having the same or different sun protection factor, but opposing lower balm 122 is not be limited to being a sunscreen. The opposing lower balm 122 may be any of a lip balm, a deodorant, an antiperspirant, a sunscreen, a moisturizing balm, a fragrance balm, and an eye black. Similarly, upper balm 122 may be any of the foregoing, and any of balms 122 may include one or more properties, including: texture, flavor, scent, color, level of sun protection factor, and consistency, regardless of whether upper balm 122 and opposing lower balm 122 are of the same type of balm. Any combination of balms 122 is intended to be within the scope of this disclosure.

Referring now to FIGS. 2A-E, depicted is perforated mounting structure 124 according to one embodiment of the present disclosure. As illustrated, perforated mounting structure 124 includes a balm anchoring structure extending from a first interior surface 252 of the perforated mounting structure 124 and comprising a joint 255 and a platform 250, the platform 250 being elevated above the joint 255. The perforated mounting structure 124 also includes a cap securing element 275, wherein the cap securing element 275 is located on a second interior surface 254 of the perforated mounting structure 124. The perforated mounting structure 124 also includes a perforated mounting structure securing element, 280, 290, and a perforated mounting structure receiving element 285, 295. A balm of the present invention encompasses at least a portion of the platform 250. In one embodiment, the balm is positioned above the joint 255. In another embodiment, the balm contacts the joint 255 and surrounds or partially surrounds the structures supporting platform 250.

Figure 2A:
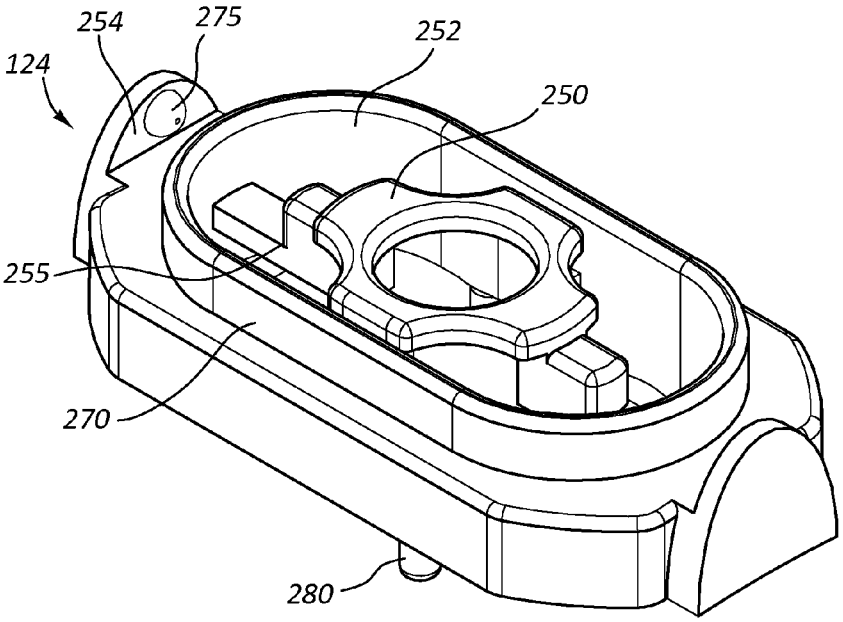
FIGS. 2A-E depict various views of a perforated mounting structure of FIG. 1 in accordance with an embodiment of the present disclosure.

Referring now to FIG. 2A, depicted is a perforated mounting structure 124 from an elevated, angled perspective. As shown therein, an elevated platform 250 is positioned within the first interior surface 252, being supported by four support structures associated with the first interior surface 252. Each support structure includes a ledge or step upon which the platform 250 rests, acting to elevate the platform 250. As depicted in FIG. 2A, the junction where the support structure steps up to elevate the platform 250 is joint 255. In one embodiment, the platform 250 is elevated with respect to joint 255; that is, platform 250 may be positioned above joint 255 when perforated mounting structure 124 is placed in an upright configuration. In another embodiment, the term "elevated" may refer to the location of platform 250 with respect to the top outer rim of perforated mounting structure 124. That is, the platform 250 in one embodiment may be located above the outer rim of perforated mounting structure 124 when said perforated mounting structure 124 is positioned upright.

In one embodiment, the platform of the present invention may be supported by any number of support structures associated with the first interior surface 252, including a substantially uninterrupted support structure emanating from the first interior surface 252. Alternatively or additionally, the platform may be supported by one or more support structures associated with the second interior surface 254 and/or an exterior surface 270 of the perforated mounting structure 124. The balm, when mounted on the perforated mounting structure of the present invention, may encompass at least a portion of the platform and extend to a position above the joint. In FIG. 2, the position above joint 255 may be any position along the ledge or step leading to the elevated platform 250.

As depicted in FIG. 2, the joint 255 is the intersection of the support structure emanating from the first interior surface 252 and the step supporting platform 250. In one embodiment, the joint of the present invention may be distinct from that as depicted in FIG. 2. As a non-limiting example, a support structure may attach to a secondary structure before connecting to and elevating the platform of the present invention. The joint may, in such an instance, be on the secondary structure and not directly associated with the original support structure. As another non-limiting example, there may be more than one joint, at least one of which is located below a position where a solidified balm is mounted on a perforated mounting structure.

Figure 2B:
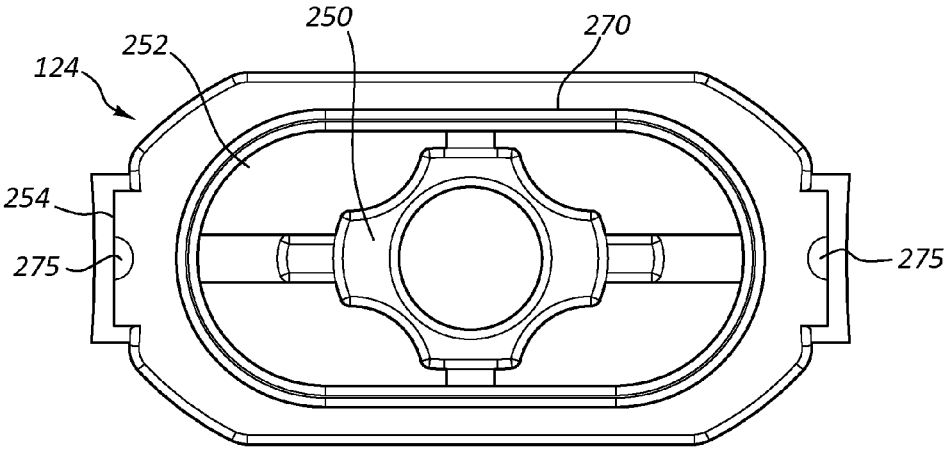

FIG. 2B depicts the perforated mounting structure 124 from an aerial/top view. FIG. 2B highlights the shape of platform 250 and the through holes in the mounting structure. The present disclosure is not meant to be limited to the shape and/or structure of the platform of the present invention or to the support structures therein but may extend to any surface that a liquefied balm can be poured through and act to hold and/or anchor a solidified balm to the perforated mounting structure.

As illustrated in FIG. 2B, cap securing element 275 is a substantially hemispherical structure associated with the second interior surface of perforated mounting structure 124. In another embodiment, the cap securing element of the present invention may be a ledge or other protrusion from the second interior surface 254 of perforated mounting structure 124. In another embodiment, the cap securing element may be any of an inlet and/or indentation that may provide a frictional fit to an opposing element on cap 160.

Figure 2C:
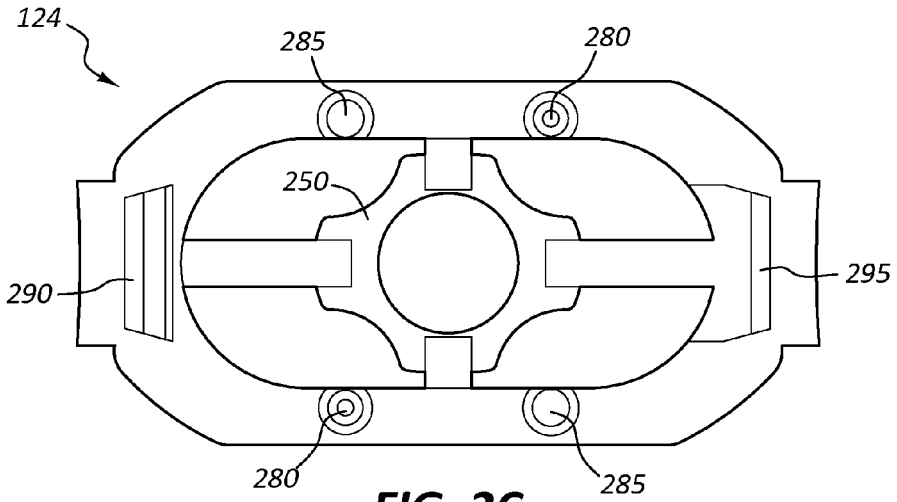

Referring now to FIG. 2C, depicted is a bottom view of perforated mounting structure 124. As depicted in FIG. 2C, the perforated mounting structure 124 contains perforated mounting structure securing elements 280, 290 and perforated mounting structure receiving elements 285, 290. In one embodiment, the securing element of the present invention may include posts, pegs, ledges, clips, hinges, and/or any other mechanical means of securing objects together and may be associated with one or more receiving elements of the present invention that may include post holes, peg holes, inlets, clips, indentations, hinges, and/or any other mechanical means of securing objects. Each of the securing elements and receiving elements may be provided for on the perforated mounting structure 124 in any number and combination. In one embodiment, the securing elements of the present invention may be the same or substantially similar, and receiving elements of the present invention may be the same or substantially similar.

In general, the perforated mounting structure securing elements of the present invention found on an upper perforated mounting structure 124 may complement receiving elements of the present invention on the opposing perforated mounting structure 124, and similarly, the upper perforated mounting structure 124 may contain receiving elements that are complementary to securing elements on the opposing perforated mounting structure. Additionally or alternatively, only one perforated mounting structure 124 may include one of securing elements and receiving elements with the other opposing perforated mounting structure 124 including the complementary securing elements or receiving elements. As a non-limiting example, perforated mounting structure 124 may have securing elements that clip into receiving elements of another perforated mounting structure 124 to fixedly and/or removably attach the two perforated mounting structures 124 of a dual balm assembly of the present invention.

Figure 2D:
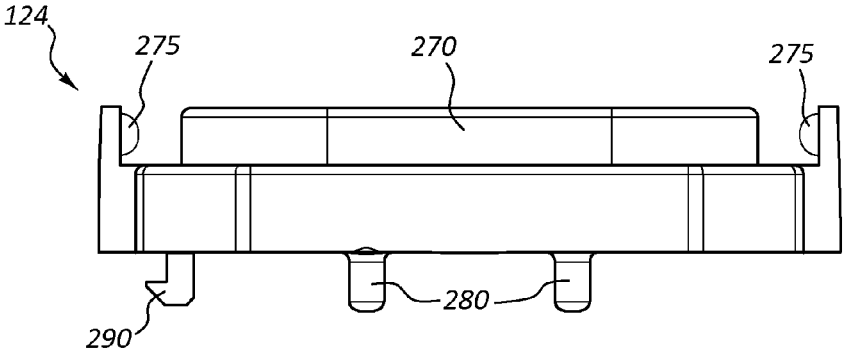

FIG. 2D depicts the perforated mounting structure 124 from the front and/or back. In at least one embodiment—and depicted in FIG. 2D—the perforated mounting structure 124 includes two securing elements 280 illustrated as posts, each post consisting of a bulbous-like head that can be inserted into a corresponding receiving structure 285 on an opposing perforated mounting structure 124 in order to fixedly attach the two perforated mounting structures 124. The perforated mounting structure depicted in FIG. 2D also includes a securing element 290 that is illustrated as a clip-like structure that clips into and is held by receiving element 295 on opposing perforated mounting structure 124, promoting a fixedly attached state of upper and opposing lower perforated mounting structures 124. The physical likeness of the securing element 280 posts should not limit the present disclosure, rather any similar mechanism for fixedly attaching the two structures can be used and preserve the essence of the aforementioned securing elements of the present invention.

Figure 2E:
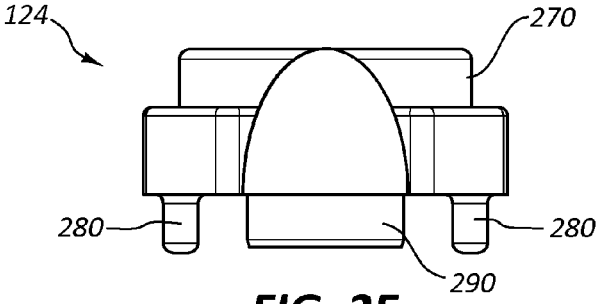

FIG. 2E depicts the perforated mounting structure 124 from an end view and illustrates an exemplary embodiment of perforated mounting structure 124 that includes two securing elements 280 and one securing element 290 that may be used to fixedly attach a perforated mounting structure 124 to another perforated mounting structure 124 having complementary receiving elements 285, 295.

Figure 3A:
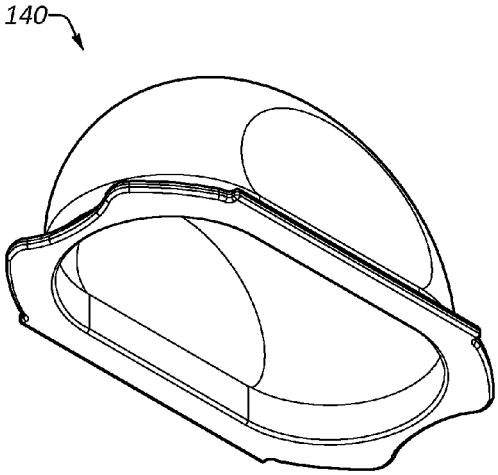
FIGS. 3A-D depict various views of a balm container cap insert of FIG. 1 in accordance with an embodiment of the present disclosure.
Figure 3B:
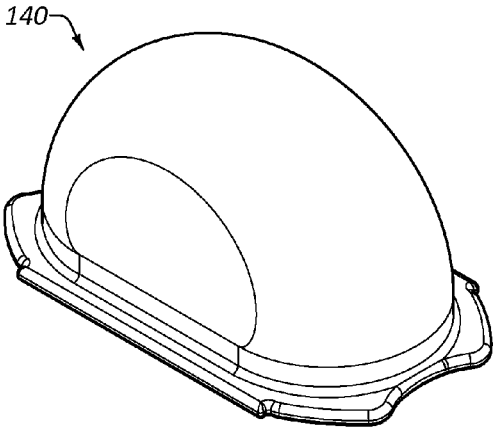
Figure 3C:
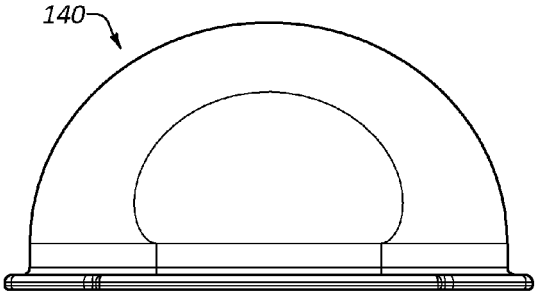
Figure 3D:
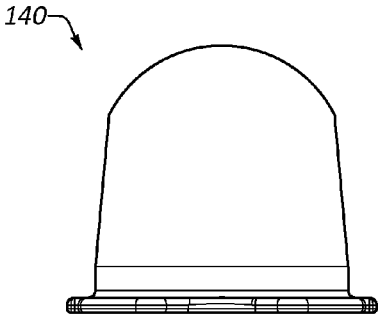

Referring now to FIGS. 3A-D, depicted are various views of cap insert 140 according to one embodiment of the present disclosure. The cap insert 140 depicted in FIG. 3 snappedly fixes to cap 160 and can be used to cover a balm 120 and/or to serve as a mold during the manufacturing process. In one embodiment, the cap insert 140 is securely, yet removably, attached to the exterior surface 270 of perforated mounting structure 124 through frictional fit interactions and filled with liquefied balm (e.g., by pouring liquefied balm through perforated mounting structure 124), after which the liquefied balm is solidified (e.g., by being cooled or being allowed to cool). The resultant balm 122 takes on the shape and contour of the interior surface of the cap insert 140, which is as illustrated in FIG. 3A.

In another embodiment, the cap insert of the present invention is snappedly and permanently fixed to a cap of the present invention, which may then securely attached to the perforated mounting structure of the present invention prior to filling with liquefied balm. In another embodiment, the cap insert may be securely attached to the perforated mounting structure followed by filling with liquefied balm with the cap being snappingly received by the cap insert. Regardless of the sequence of assembly, the cap insert may associate with the perforated mounting structure and serve as a mold for forming a solid balm through a hot pour process.

In one embodiment, the cap insert of the present invention may be coated with a lubricant or other chemical and/or material that may assist in the proper formation of balm 122 and release of said balm 122 from the interior surface of the cap insert. In another embodiment, a chemical or other material may be added to the interior surface of the cap insert to add flavor, color, texture, chemical (organic or otherwise), and/or scent or other desired quality to the resultant balm.

In one embodiment, cap inserts of the present invention may be removably attached to balm 122 in the final commercial product such that removal of the cap insert will reveal the balm 122. The foregoing association between the cap insert and balm 122 may be through direct contact. Alternatively, the cap insert may not directly contact the balm 122, but may, rather, act to cover the balm 122 without contacting balm 122.

Referring now to FIGS. 4A-D balm container cap 160 is shown. In at least one embodiment and as depicted in the perspective view shown in FIG. 4B, the cap 160 has an exterior surface and an interior surface wherein the cap 160 includes a first attachment element 300 located on the interior surface and a second attachment element 305 located on the exterior surface. The cap insert 140 is fixedly attached to the first attachment element 300 of the cap 160 to secure the cap insert 140 and cap 160 into a single functional piece. That is, in one embodiment, removal of the cap 160 from dual balm applicator 100 may act to effectively remove the attached cap insert 140 together with cap 160.

Figure 4A:
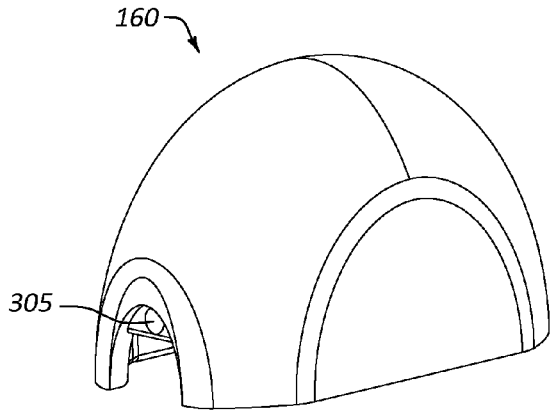
FIGS. 4A-D depict various views of a balm container cap of FIG. 1 in accordance with an embodiment of the present disclosure.
Figure 4B:
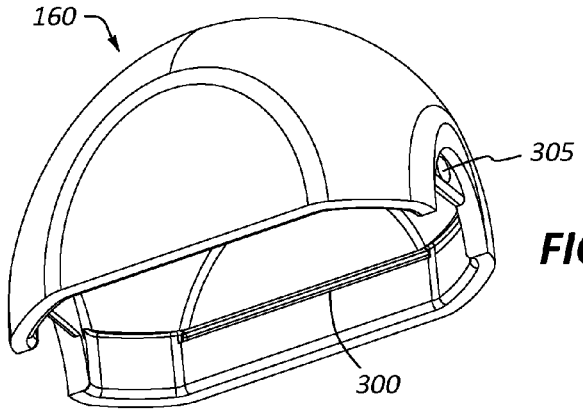
Figure 4C:
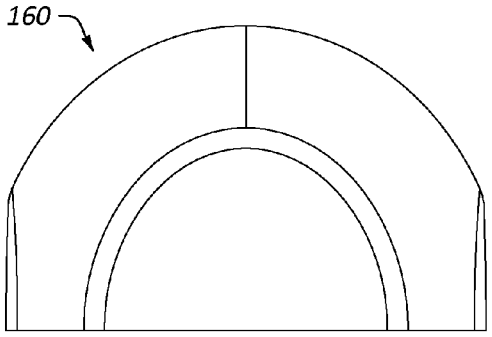
Figure 4D:
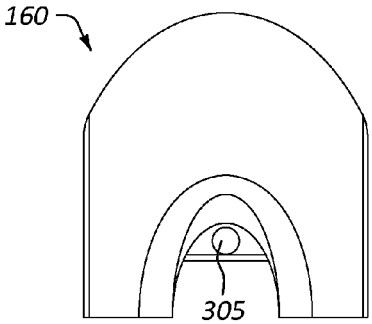

As depicted in FIGS. 4A, 4B, and 4D, cap 160 includes a second attachment element 305 on the exterior surface. The second attachment element 305 interacts with cap securing element 275 of the perforated mounting structure 124 to hold and/or secure the cap 160 to the perforated mounting structure 124. FIG. 4 illustrates the second attachment element 305 as a hemispherical indent that complements the hemispherical knob of cap securing element 275 depicted in FIG. 2. In one embodiment, the cap securing element of the present invention may be a protrusion instead of an indentation with the complementary cap securing element of the present invention being an indentation. Alternatively, both the cap securing element and the second attachment element may be one or more protrusions.

In any of the foregoing embodiments, the second attachment element and the cap securing element of the present invention may interact through any of a frictional fit, an interference fit, or similar means of releasably securing the elements such as via a hinge. As a non-limiting example, second attachment element may be a protruding ledge that when engaging the cap securing element—which may be another protruding ledge—the second attachment element passes over cap securing element and rests on the opposing side of cap securing element acting to secure the cap to the perforated mounting structure. The cap of the present invention may be removably secured to the perforated mounting structure in the foregoing example, being removed with an application of sufficient force to displace the overlapping ledges of second attachment element and cap securing element.

In one embodiment, the cap, cap insert, and/or mounting structure of the present invention are comprised of a molded thermoplastic material. In another embodiment, the cap and/or other elements may be comprised of one or more materials chosen from the group consisting of: thermoplastics, thermoplastic elastomers, plastics, metals, woods, and rubbers. In one embodiment, the cap may be comprised of a different material than the cap insert. As a non-limiting example, the cap may be molded from a tactilely softer material such as rubber and/or a thermoplastic elastomer whereas the cap insert may be made from a tactilely harder material such as a thermoplastic. As another non-limiting example, the cap may be whittled from a block of wood for an organic external look and feel while the cap insert may be molded from a thermoplastic to potentially maintain functionality and ease of manufacturing.

Figure 5A:
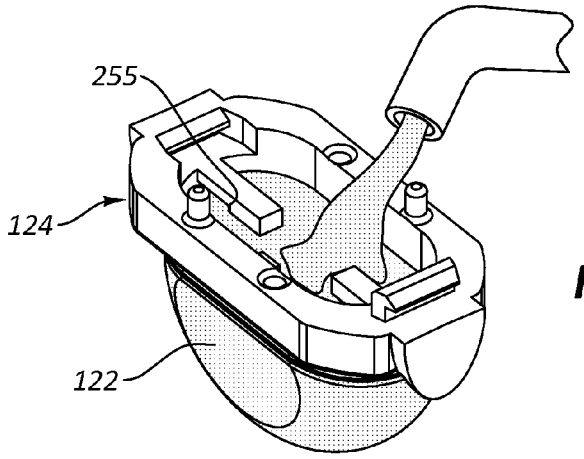
FIGS. 5A-C depict a representation of a portion of a method of manufacturing a dual balm applicator using the components of FIG. 1 in accordance with an embodiment of the present disclosure.
Figure 5B:
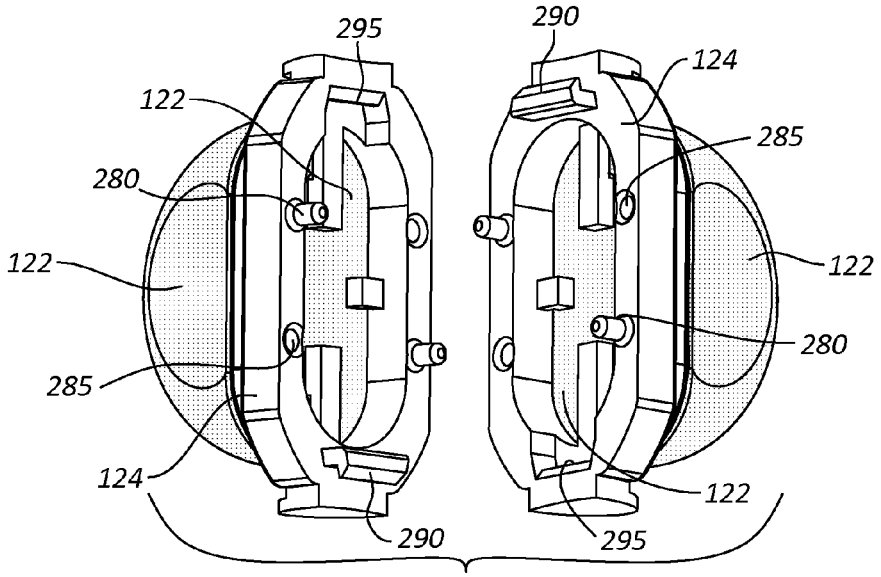
Figure 5C:
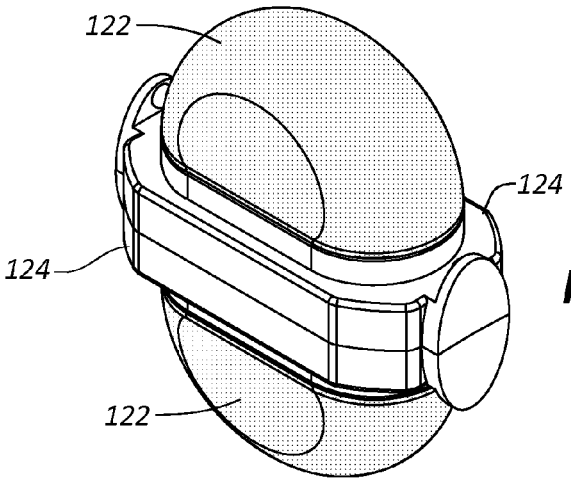

Referring now to FIGS. 5A-C, depicted is the partial manufacturing and partial assembly of a dual balm applicator 100 according to one embodiment of the present disclosure. FIG. 5A depicts a perforated mounting structure 124 having been filled with a liquefied balm to a position extending above joint 255 such that joint 255 remains uncovered by balm 122. In another embodiment joint 255 is covered by the balm, along with the support structures emanating from the first interior surface 252 to support platform 250, which may be contacted by and surrounded by balm.

Not depicted in FIGS. 5A-C, but which may be present during the forming of the balm, is a cap insert of the present invention attached to perforated mounting structure 124 while liquefied balm is poured through structure 124.

In one embodiment, and as partially depicted throughout FIG. 5, a method for making a dual balm applicator includes forming at least two balm subassemblies, wherein each balm subassembly includes one or more cap inserts 140 and one or more perforated mounting structures 124, with each of the foregoing having any and/or all of the properties discussed above. Each balm subassembly may also include one or more caps 160.

In one embodiment, the method further includes inverting an at least partially assembled balm subassembly. In one embodiment, partial balm subassembly may include having only the perforated mounting structure, whereas in another embodiment, partial balm subassembly may include associating at least one cap insert of the present invention, with at least one cap of the present invention, and which may be associated with at least one perforated mounting structure of the present invention. Other embodiments may include any combination of the foregoing.

In one embodiment, the method further includes inverting at least two balm subassemblies (each subassembly comprising, for example, a structure 124 and an insert 140) and pouring liquefied phase balm through the perforated mounting structure 124 and into the associated cap inserts 140 of each balm subassembly, then solidifying the balm (e.g., cooling or allowing the liquefied balm to solidify through cooling), so as to be mounted on the respective structure 124, thereby forming at least two balm assemblies that are ready for use. For example, in one embodiment, the liquefied phase balm is poured through an opening in the structure 124 of the present invention.

In one embodiment, the liquefied phase balm may be poured into a cast and/or mold. The liquefied phase balm may thus be poured until the cap insert and/or cast and/or mold is filled such that the liquefied phase balm encompasses at least a portion of the platform 250.

As depicted in FIGS. 5B and 5C, the method may further include attaching a first balm assembly to a second balm assembly of the at least two balm assemblies by communicating an upper perforated mounting structure securing element 280, 290 of the first balm assembly with the perforated mounting structure receiving element 285, 295 of the second balm assembly. In one embodiment, both the first and second balm assemblies may include securing elements 280, 290 and receiving elements 285, 295 such that when the two balm assemblies are attached, each balm assembly communicates a securing element 280, 290 to a receiving element 285, 295 of the opposing balm assembly.

Thus, a method of making a dual balm applicator comprises (i) providing at least two balm subassemblies, wherein each of the at least two balm subassemblies comprises: (A) a perforated mounting structure 124; and (B) a cover (e.g., cap 160 and/or insert 140) configured to be selectively, removably mounted on the perforated mounting structure 124; (ii) inverting the at least two balm subassemblies; (iii) pouring liquefied phase balm through the perforated mounting structures 124 of the respective at least two balm subassemblies and into the covers of the respective at least two balm subassemblies such that the liquefied phase balm is mounted on at least a portion of the perforated mounting structures (iv) of the at least two balm subassemblies; (v) solidifying the liquefied phase balm (e.g., cooling or allowing to cool) such that the balm becomes mounted on the perforated mounting structures 124 of the at least two balm subassemblies, thereby forming at two balm assemblies 120; and (vi) attaching at least two balm assemblies to each other by communicating perforated mounting structures of respective balm assemblies with each other.

The current disclosure should not be limited to the sequence in which the dual balm applicator of the present invention is constructed, so long as the final product is functionally equivalent. For example, in one embodiment, the balm may be formed and anchored to the perforated mounting structure within an external mold that is not part of the final dual balm applicator product.

In one embodiment, the securing element of the present invention may communicate with the perforated mounting structure receiving element of the present invention via an interference fit. Alternatively or additionally, the securing element may communicate with the receiving element via a press fit and/or a compression fit connection. In any and/or all of the preceding embodiments, the securing element and the receiving element may be fixedly attached. In one embodiment, and regardless of securing elements and receiving elements, the perforated mounting structures may be attached through the use of one or more adhesives.

In yet another embodiment of the present invention, each balm assembly may be releasably connected such that the balm assemblies are interchangeable. In one embodiment, balm assemblies of the present invention may twist off, hinge off, and/or snap off to release and may be replaced by the same or a different balm assembly. As a non-limiting example, a dual balm applicator may have a lip balm with an opposing sunscreen, and the lower balm assembly containing the sunscreen may be disengaged from the upper balm assembly, which includes the lip balm. The upper balm assembly, which includes the lip balm, may then be engaged with a second balm assembly having a lip balm. The lip balms of the newly assembled dual balm applicator may have, as a non-limiting example, the same flavors, but in some embodiments, each of the two lip balms may have, for example, different flavors.

Figure 6:
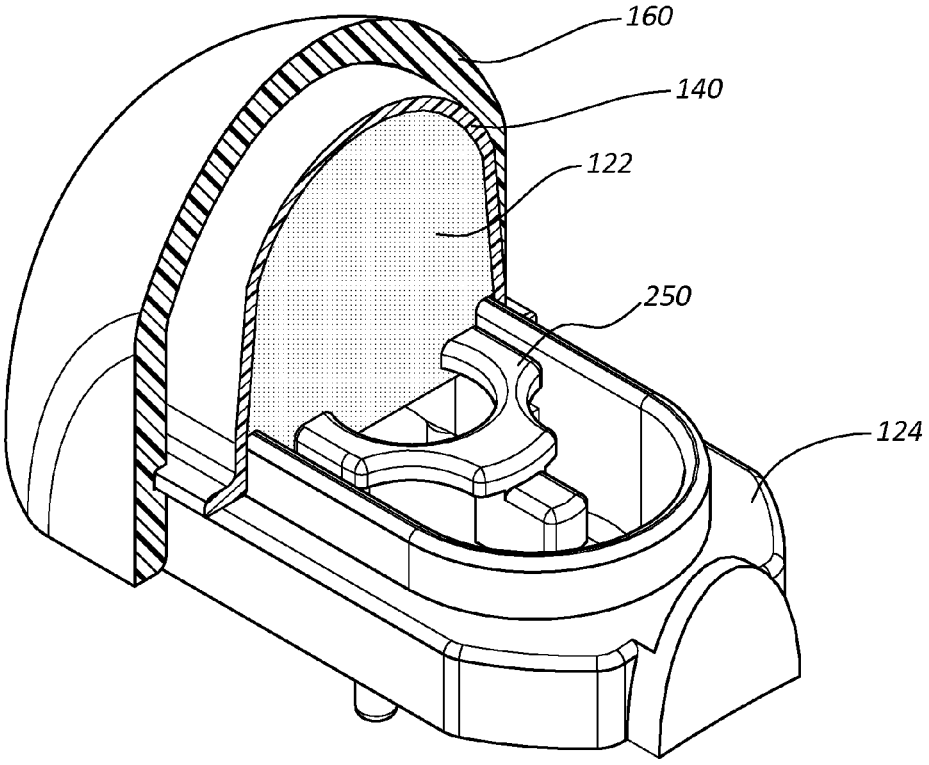
FIG. 6 depicts a cross-sectional view of a mounted and capped balm in accordance with an embodiment of the present disclosure.
Figure 7A:
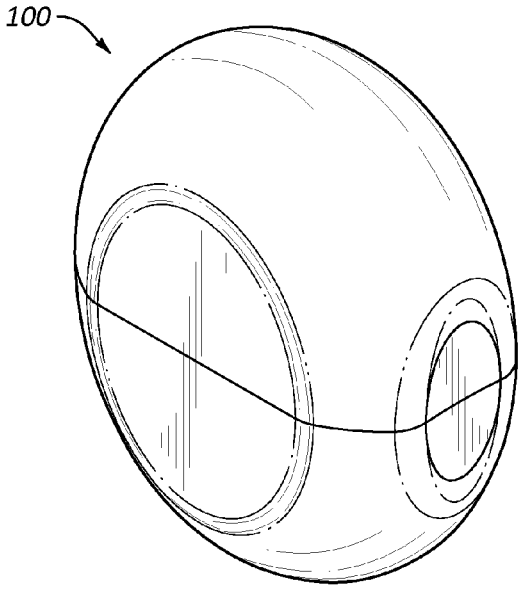
FIGS. 7A-G depict a fully assembled and closed dual balm applicator using the components of FIG. 1 in accordance with an embodiment of the present disclosure.
Figure 7B:
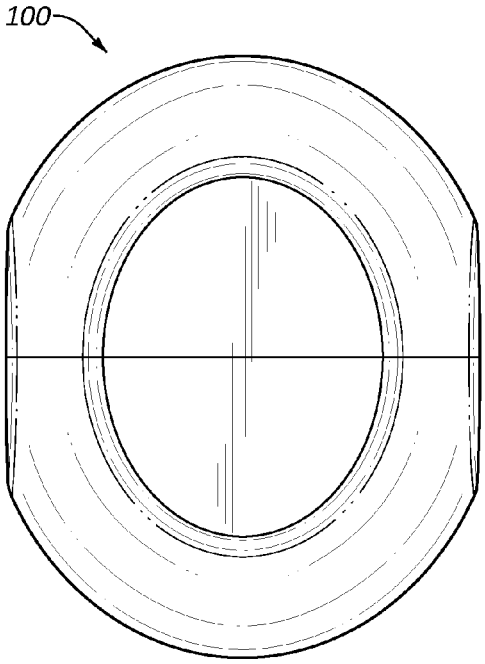
Figure 7C:
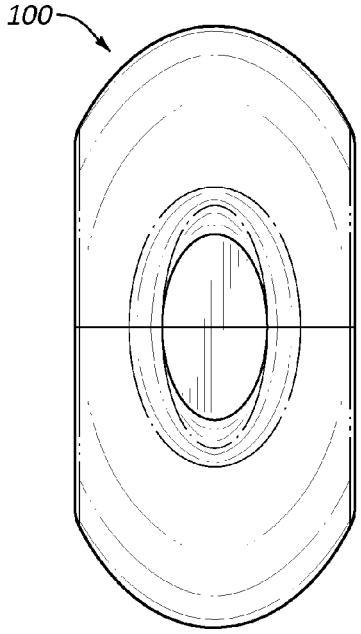
Figure 7F:
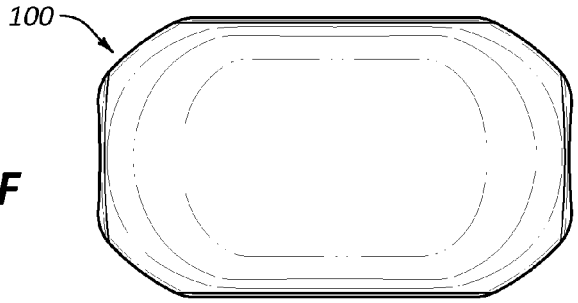
Figure 7E:
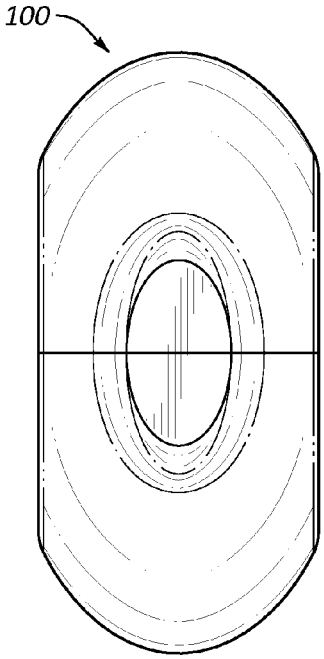
Figure 7D:
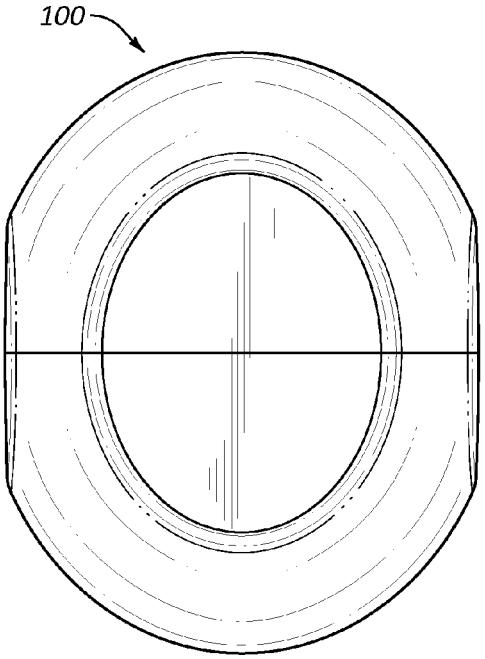
Figure 7G:
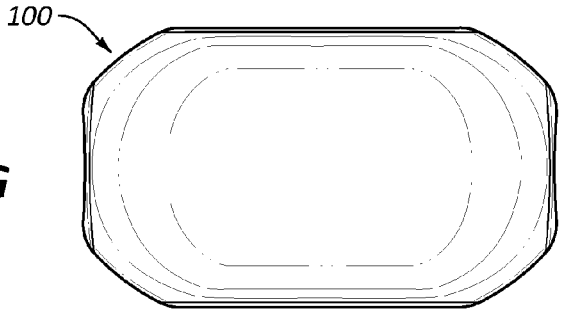
Figure 8A:
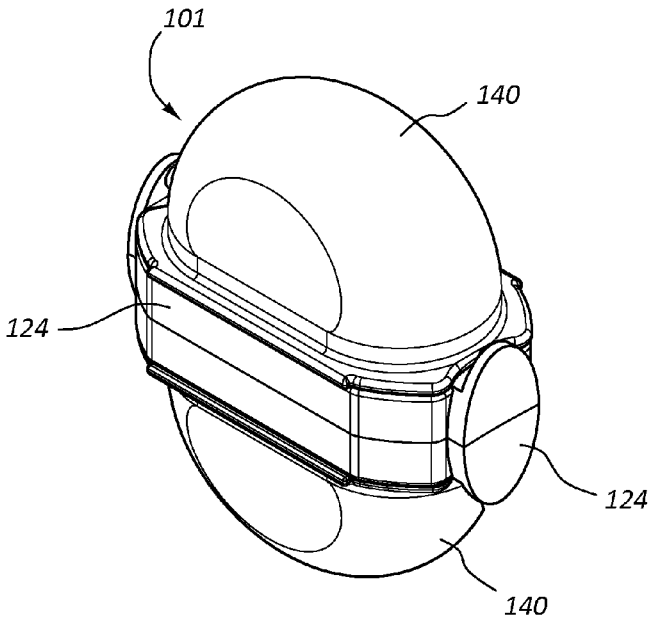
FIG. 8A-G depicts a capless balm assembly using the components of FIG. 1 in accordance with an embodiment of the present disclosure.
Figure 8B:
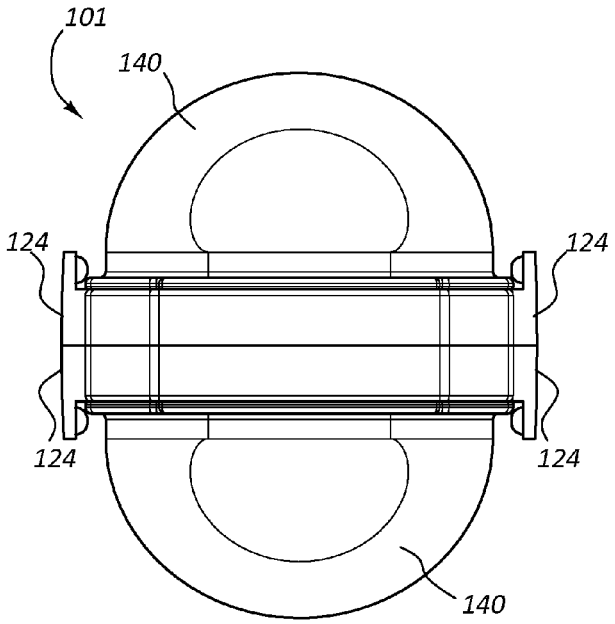
Figure 8C:
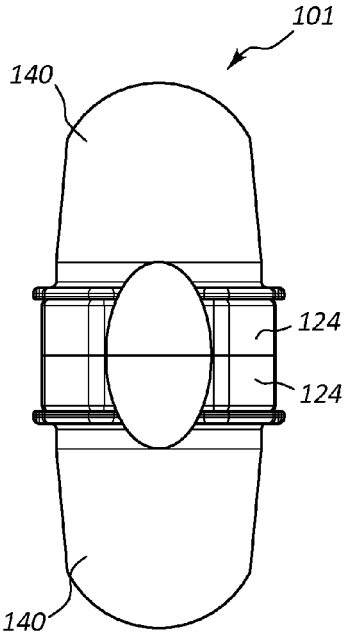
Figure 8F:
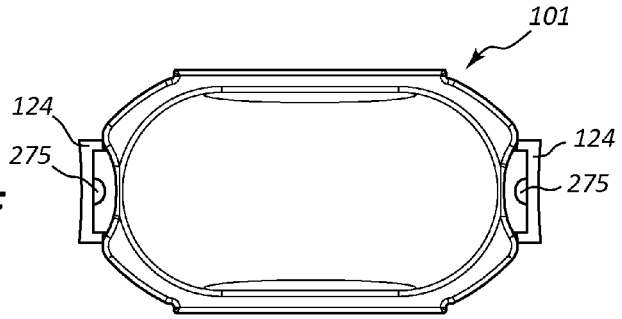
Figure 8E:
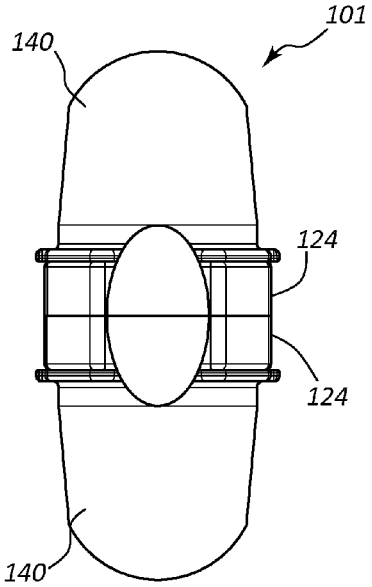
Figure 8D:
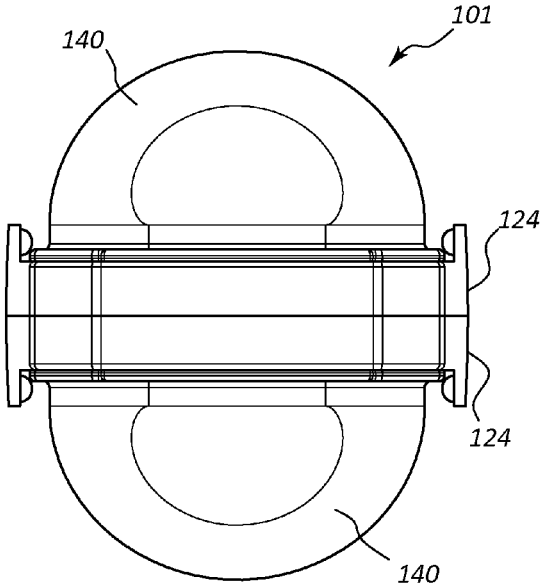
Figure 8G:
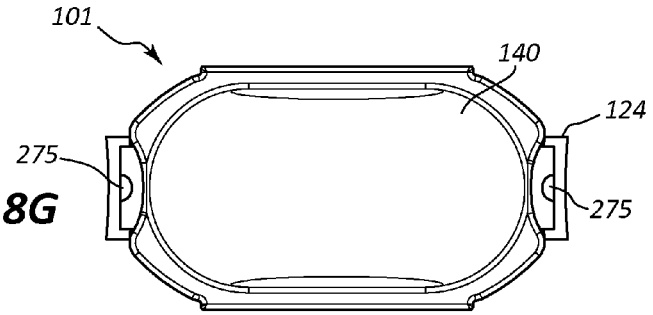

FIG. 6 depicts a cross-sectional view of a mounted and capped balm 122 in accordance with an embodiment of the present disclosure. As depicted in FIG. 6, the balm 122 extends into the interior surface 252 of perforated mounting structure 124 and is enmeshed with the platform 250, anchoring said balm 122 to the perforated mounting structure 124. Also as depicted in FIG. 6, balm 122 is covered by cap 160 having an attached cap insert 140, the balm 122 communicating snugly with cap insert 140.

Referring now to FIG. 7, depicted are various viewpoints (FIGS. 7A-G) of a fully assembled and closed dual balm applicator 100 using the components of FIG. 1 in accordance with an embodiment of the present disclosure. Depicted is a dual balm applicator 100 having an elliptical body with multiple flattened sides. Dual balm applicator 100 includes opposing caps 160, wherein the opposing caps 160 are configured to be removed and wherein the opposing caps 160 are fitted with cap insert 140, and a dual balm assembly. The dual balm assembly may include two or more balm anchoring structures that extend from an interior surface of the dual balm assembly, wherein the two or more balm anchoring structures each comprise a joint and a platform, the platform being elevated above the joint. Each balm anchoring structure has a respective balm thereon positioned beneath a respective cap 160 and communicates with a respective cap insert 140 of a respective cap 160. The balms 122 may also be attached to each respective balm anchoring structure with each of the balms 122 encompassing at least a portion of a respective platform.

As shown in FIG. 7, when the cap 160 of each respective lip balm assembly is mounted on a respective perforated mounting structure, the dual balm applicator 100 has the shape of an elliptical body having two flattened sides. Applicator 100 can be rested on such flattened sides as desired by a user when applicator 100 is not in use. The elliptical shape also efficiently uses space while providing a curved balm surface which is comfortable against a user's skin.

Referring now to FIGS. 8A-G, depicted are various views of a capless dual balm assembly 101 in accordance with an embodiment of the present disclosure. The capless dual balm assembly 101 depicted in FIGS. 8A-G includes cap inserts 140 housing respective balms 122 (not shown in FIGS. 8A-8G) removably secured to respective perforated mounting structures 124. As depicted, the cap inserts 140 do not interfere with cap securing element 275 (see FIGS. 8B, 8D, 8F, and 8G) such that caps 160 may be associated with the depicted capless dual balm assembly 101. In one embodiment, the caps of the present invention may engage the cap inserts of the present invention such that when removed, the cap inserts are associated with respective caps.

When applicator 100 is formed, as illustrated in FIGS. 1, 7A-G and 8A-G, the balms 122 of each respective balm assembly 120 extend away from the respective attached perforated mounting structures 124 for convenient use by a user. A user can conveniently remove the cover(s) coving the opposing balms 122 and apply one or more flavors or types of balms 122 to the users lips or skin. As used with respect to this invention, the caps 160 and/or cap inserts 140 are examples of covers of the present invention which cover and protect balm.

Thus, dual balm applicator 100, comprises two balm assemblies 120 that are attached to each other, wherein each of the two balm assemblies comprises: (i) a perforated mounting structure 124; (ii) a balm 122 mounted on the perforated mounting structure 124; and (iii) a cover configured to be selectively, removably mounted on the perforated mounting structure, wherein the perforated mounting structures 124 of each respective balm assembly 120 are attached to each other, such that the balms 122 of each respective balm assembly 120 extend away from the respective attached perforated mounting structures 124 for convenient use by a user.

Figure 9:
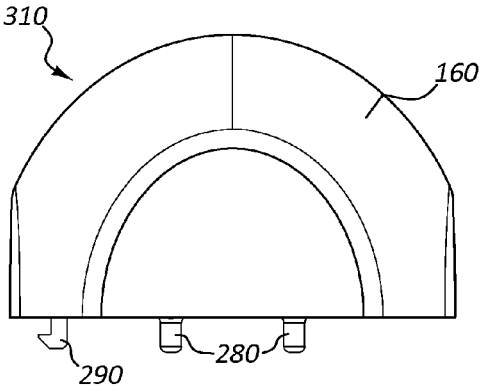
FIG. 9 depicts one half of a fully assembled dual balm applicator using at least a portion of the components of FIG. 1 in accordance with an embodiment of the present disclosure.

Referring now to FIG. 9, depicted is one half of a fully assembled dual balm applicator 100 using at least a portion of the components of FIG. 1 in accordance with an embodiment of the present disclosure. The single balm applicator 310 of dual balm applicator 100 includes, as illustrated, cap 160 and securing elements 280, 290, which are used to fixedly connect two single balm applicators 310 to create a dual balm applicator 100 as described previously.

Figure 10:
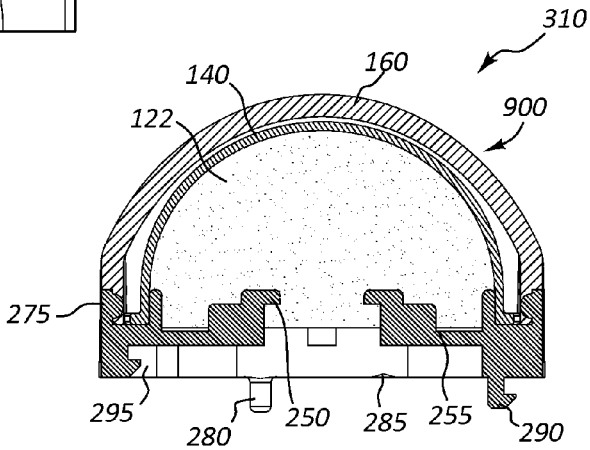
FIG. 10 depicts a cross-sectional view of the balm applicator from FIG. 9 in accordance with an embodiment of the present disclosure.

Referring now to FIG. 10, depicted is a cross-sectional view of the single balm applicator 310 from FIG. 9 in accordance with an embodiment of the present disclosure. The single balm applicator 310 includes a cap 160 with an associated cap insert 140 housing balm 122. The balm 122, as illustrated by FIG. 10, is associated with perforated mounting structure 124, such that the balm 122 is enmeshed and/or anchored to platform 250. As depicted in FIG. 10, the balm 122 is anchored to the platform 250 and is associated with perforated mounting structure 124 above joint 255, but may contact joint 255 in other embodiments.

The single balm applicator 310 also includes a perforated mounting structure 124 having securing elements 280, 290 and receiving elements 285, 295 for fixedly and/or removably attaching two single balm applicators 310 to create a dual balm applicator 100. As illustrated in FIG. 10, the securing elements 280 include posts that communicate with complementary receiving element 285, which is depicted as a post-sized hole, and the securing element 290 include clips which communicate with receiving element 295, which is depicted as a complementary void with and ledge. The securing elements 280, 290 and receiving elements 285, 295 are for illustrative purposes only and are not meant to be limiting of the scope and/or necessary configurations of single balm applicator 310.

Figure 11:
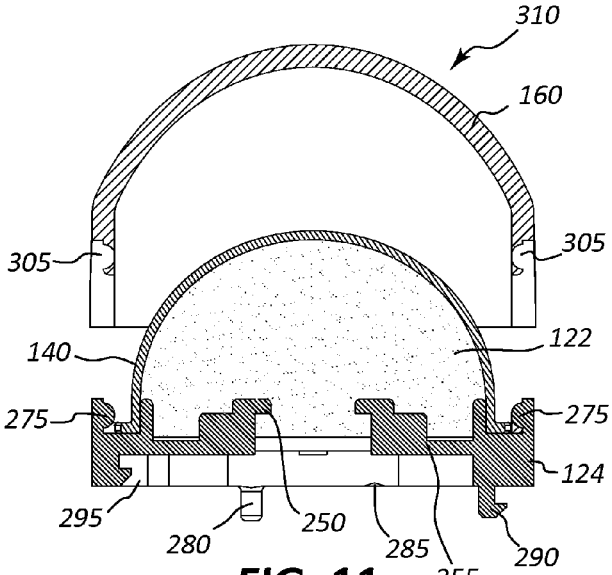
FIG. 11 depicts a cross-sectional view of the balm applicator from FIG. 9 with the cap unattached in accordance with an embodiment of the present disclosure.

Referring now to FIG. 11, depicted is a cross-sectional view of the balm applicator from FIGS. 9 and 10 with the cap 160 unattached in accordance with an embodiment of the present disclosure. The reference numbering is consistent between FIGS. 10 and 11 and represents the same or substantially similar structures. Revealed in FIG. 11 are cross-sectional views of cap securing element 275 and second attachment element 305. Upon securing cap 160 to perforated mounting structure 124, cap securing element 275 engages second attachment element 305 to secure the cap 160.

Figure 12:
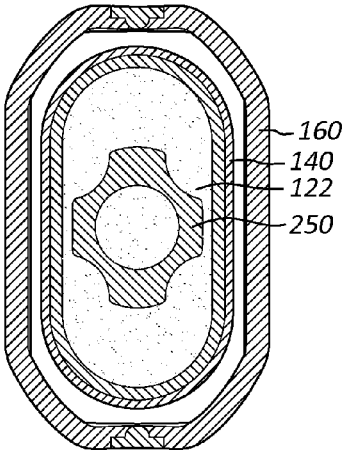
FIG. 12 depicts an aerial cross-sectional view of the balm applicator from FIG. 9 in accordance with an embodiment of the present disclosure.

Referring now to FIG. 12, depicted is an aerial cross-sectional view of the single balm applicator 310 from FIG. 9 in accordance with an embodiment of the present disclosure. Illustrated in FIG. 12 is cap 160, exterior to cap insert 140, which is, in turn, exterior to balm 122. The balm 122 is illustrated as encompassing platform 250 such that the balm surrounds the exterior surface of the platform 250 to aid in anchoring the balm 122 on and/or within perforated mounting structure 124 of single balm applicator 310.

Figure 13:
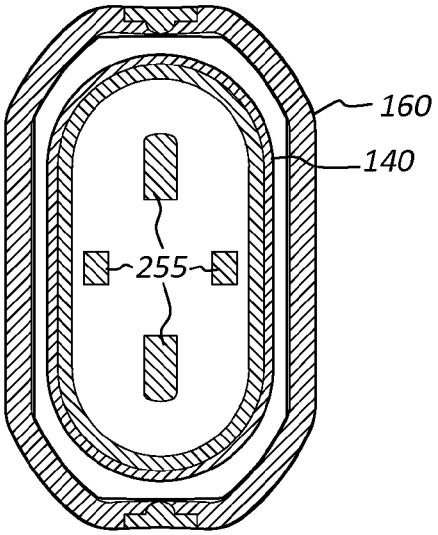
FIG. 13 depicts an aerial cross-sectional view of the balm applicator from FIG. 9 in accordance with an embodiment of the present disclosure.

Referring now to FIG. 13, depicted is an aerial cross-sectional view of the balm applicator from FIG. 9 in accordance with an embodiment of the present disclosure. This aerial cross-section, as opposed to the cross-sectional view of FIG. 12 is depicted sectioned at joint 255.

Figure 14:
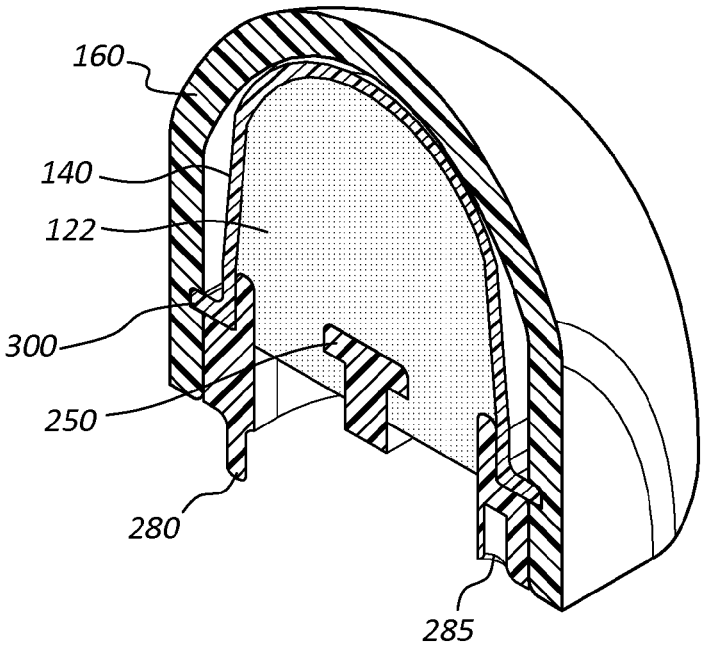
FIG. 14 depicts a perspective cross-sectional view of the balm applicator FIG. 9 in accordance with an embodiment of the present disclosure.

Referring now to FIG. 14, depicted is a perspective cross-sectional view of the single balm applicator 310 from FIG. 9 in accordance with an embodiment of the present disclosure. The single balm applicator 310 is depicted as having a cap 160 associated with cap insert 140, the first attachment element 300 of cap 160, which acts to selectively secure cap insert 140 within cap 160 being illustrated. Cap insert 140 may, as depicted in FIG. 14 associate directly with balm 122. The balm 122 is illustrated as being associated with platform 250 of perforated mounting structure 124. Also depicted is securing element 280, shown as a post-like element and a receiving element 285, which is depicted as a post-sized and shaped indentation within perforated mounting structure 124.

In at least one embodiment, a dual balm applicator of the present invention is manufactured by a hot pour process, but instead of attaching the perforated mounting structures 124 to one another, the balms and associated perforated mounting structures 124 are inserted into a case such that the perforated mounting structures 124 are exterior to the application surfaces of the balms, which are facing each other within the case structure. As used with respect to this invention, the caps 160 and cap inserts 140 are each examples of covers of the present invention.

Some embodiments of the present disclosure may include a dual balm applicator comprising two balm assemblies, wherein each of the two balm assemblies comprises and/or includes (i) a cap, the cap having an exterior surface and an interior surface and wherein the cap includes a first attachment element located on the interior surface and a second attachment element located on the exterior surface; (ii) a cap insert, wherein the cap insert is selectively attached to the first attachment element of the cap; and (iii) a perforated mounting structure. The perforated mounting structure may further comprise: a balm anchoring structure extending from a first interior surface of the perforated mounting structure and comprising a joint and a platform, the platform being elevated above the joint; a cap securing element, wherein the cap securing element is located on a second interior surface of the perforated mounting structure and releasably attaches to the second attachment element of the cap; a perforated mounting structure securing element; a perforated mounting structure receiving element; and a balm, wherein the balm encompasses at least a portion of the platform. The balm assembly may include the perforated mounting structure securing element of a first balm assembly communicating with the perforated mounting structure receiving element of a second balm assembly, attaching the first and second balm assemblies.

In one embodiment, the dual balm applicator described above may further include the cap being removably secured to the perforated mounting structure. In another embodiment, the cap is comprised of a material chosen from the group consisting of: thermoplastics, thermoplastic elastomers, plastics, metals, woods, and rubbers. In another embodiment, the cap insert is comprised of a different material than the cap. In another embodiment, the cap insert removably interfaces with the balm.

In one embodiment, the elevated platform includes an opening. In another embodiment, the balm is selected from the group consisting of: a lip balm, a deodorant, an antiperspirant, a sunscreen, a moisturizing balm, and a fragrance balm. In another embodiment, the balm comprises one or more properties selected from the group consisting of: flavors, scents, colors, sun protection factor, and textures. In one embodiment, the balm from each of the two balm assemblies is a lip balm having different flavors. In another embodiment, the two balm assemblies are interchangeable. In another embodiment, the two balm assemblies are fixedly attached.

In one embodiment, the second attachment element of the cap and the cap securing element interact through an interference fit. In another embodiment, the perforated mounting structure securing element communicates with the perforated mounting structure receiving element via an interference fit. In another embodiment, the perforated mounting structure securing element communicates with the perforated mounting structure receiving element via a compression fit.

One embodiment of the present disclosure may include a method of making a dual balm applicator, comprising: forming at least two balm assemblies, inverting the at least two balm assemblies, pouring liquefied phase balm through the perforated mounting structure and into the cap insert of the at least two balm assemblies, filling the cap insert of each of the at least two balm assemblies with the liquefied phase balm such that the liquefied phase balm encompasses at least a portion of the platform, and attaching a first balm assembly to a second balm assembly of the at least two balm assemblies by communicating the perforated mounting structure securing element of the first balm assembly with the perforated mounting structure receiving element of the second balm assembly. The method may further include the balm assemblies being removably attached and interchangeable. This method enables the convenient hot pouring of liquefied balm through structures 124 and the convenient connection of two identical or substantially similar structures 124 to form the highly useful and convenient dual balm applicator 100 of the present invention.

One embodiment of the present disclosure may include a dual balm applicator comprising: an elliptical body having one or more flattened sides, the elliptical body comprising: opposing caps, wherein the opposing caps are configured to be removed and wherein the opposing caps are fitted with cap inserts; and a dual balm assembly, the dual balm assembly comprising: two or more balm anchoring structures that extend from an interior surface of the dual balm assembly, wherein the two or more balm anchoring structures individually comprise a joint and a platform, the platform being elevated above the joint; and at least two balms, the at least two balms being positioned beneath the opposing caps and communicating with the cap inserts of the opposing caps and being attached to the two or more balm anchoring structures, wherein each of the balms encompass at least a portion of the respective platform.

The foregoing embodiment and/or other embodiments of the present disclosure may include each balm of the at least two balms being selected from the group consisting of: a lip balm, a deodorant, an antiperspirant, a sunscreen, a moisturizing balm, a fragrance balm, and an eye black. In another embodiment, the at least two balms comprise include one or more properties selected from the group consisting of: flavor, scent, color, sun protection factor, deodorant, and texture. In another embodiment, the opposing caps interact with the dual balm assembly through an interference fit.

Additional features and advantages of exemplary implementations of the invention will be set forth in the description which follows, and in part will be obvious from the description, or may be learned by the practice of such exemplary implementations. The features and advantages of such implementations may be realized and obtained by means of the instruments and combinations particularly pointed out in the appended claims. These and other features will become more fully apparent from the following description and appended claims, or may be learned by the practice of such exemplary implementations as set forth hereinafter.

The present art may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

We claim:

1. A dual balm applicator, comprising:

two balm assemblies that are attached to each other, wherein each of the two balm assemblies comprises:

a perforated mounting structure;

a balm mounted on the perforated mounting structure; and a cover configured to be selectively, removably mounted on the perforated mounting structure;

wherein the perforated mounting structures of each respective balm assembly are attached directly to each other, such that the balms of each respective balm assembly extend away from the respective attached perforated mounting structures and also extend away in opposite directions from each other for convenient use by a user and wherein the perforated mounting structure and the cover of each of the two balm assemblies have the same shape and configuration.

2. The dual balm applicator as in claim 1, wherein the cover comprises a cap insert and a cap.

3. The dual balm applicator as in claim 1, wherein the cover comprises a cap insert.

4. The dual balm applicator as in claim 1, wherein the cover comprises a cap.

5. The dual balm applicator as in claim 1, wherein the cover comprises a cap connected to a cap insert.

6. The dual balm applicator as in claim 1, wherein each cover removably interfaces with a respective balm.

7. The dual balm applicator as in claim 1, wherein each perforated mounting structure includes an opening.

8. The dual balm applicator as in claim 1, wherein each balm is comprised of a different material than the other balm.

9. The dual balm applicator as in claim 1, wherein each balm is a lip balm having different flavor from the other balm such that the dual balm applicator provides balms having different flavors.

10. The dual balm applicator as in claim 1, wherein the two balm assemblies are fixedly attached.

11. The dual balm applicator as in claim 1, wherein each cover interacts with a respective perforated mounting structure through an interference fit.

12. A dual balm applicator, as recited in claim 1, wherein when the cover of each respective lip balm assembly is mounted on a respective perforated mounting structure, the dual balm application has the shape of an elliptical body having one or more flattened sides.

13. A method of making a dual balm applicator, the method comprising:

providing at least two balm subassemblies having the same shape and configuration, wherein each of the at least two balm subassemblies comprises:

a perforated mounting structure; and a cover configured to be selectively, removably mounted on the perforated mounting structure;

inverting the at least two balm subassemblies;

pouring liquefied phase balm through the perforated mounting structures of the respective at least two balm subassemblies and into the covers of the respective at least two balm subassemblies such that the liquefied phase balm is mounted on at least a portion of the perforated mounting structures of the at least two balm subassemblies;

solidifying the liquefied phase balm such that the balm becomes mounted on the perforated mounting structures of the at least two balm subassemblies, thereby forming at least two balm assemblies; and attaching at least two balm assemblies directly to each other by communicating perforated mounting structures of respective balm assemblies with each other such that respective balms on the at least two balm assemblies extend away from each other in opposite directions for convenient use by a user.

14. The method of making a dual balm applicator as in claim 13, wherein the cover comprises a cap insert.

15. The method of making a dual balm applicator as in claim 13, wherein each cover removably interfaces with a respective balm.

16. The method of making a dual balm applicator as in claim 13, wherein the balm of one of the at least two balm assemblies is comprised of a different material than the balm of the other of the at least two balm assemblies.

17. The method of making a dual balm applicator as in claim 16, wherein each balm is a lip balm having a different flavor from the other balm such that the dual balm applicator provides balms having different flavors.

18. A dual balm applicator enabling use of different balms by a user, the dual balm applicator, comprising:

two perforated mounting structures that have the same shape and configuration and are connected directly to each other, wherein each of the perforated mounting structures has a balm mounted thereon that encompasses at least a portion of the respective perforated mounting structure, each balm comprised of a different material than the other balm, such that each balm extends away from the other balm in an opposite direction and from a respective perforated mounting structure; and two opposing covers, each having the same shape and configuration wherein each of the opposing covers selectively, releasably attaches to a respective perforated mounting structure, thereby enabling convenient use of the respective balms by a user.

19. A dual balm applicator, as recited in claim 18, wherein when the cover of each respective lip balm assembly is mounted on a respective perforated mounting structure, the dual balm application has the shape of an elliptical body having one or more flattened sides.

20. The dual balm applicator as in claim 18, wherein the two opposing covers interact with respective perforated mounting structures through an interference fit.

* * * * *